US010680390B2

(12) United States Patent
Sanger et al.

(10) Patent No.: US 10,680,390 B2
(45) Date of Patent: Jun. 9, 2020

(54) SHIELDING ELEMENT FOR A CONNECTOR AND HOUSING ASSEMBLY HAVING PROTRUDING CUTTING PORTIONS

(71) Applicant: TE Connectivity Germany GmbH, Bensheim (DE)

(72) Inventors: Walter Sanger, Furth (DE); Wolfgang Balles, Mannheim (DE); Joachim Toboldt, Furth (DE); Dominik Kasper, Dudenhofen (DE); Stefan Wallner, Moerlenbach (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/956,196

(22) Filed: Apr. 18, 2018

(65) Prior Publication Data

US 2018/0241158 A1 Aug. 23, 2018

Related U.S. Application Data

(63) Continuation of application No. PCT/EP2016/075377, filed on Oct. 21, 2016.

(30) Foreign Application Priority Data

Oct. 22, 2015 (DE) ..... 10 2015 220 661

(51) Int. Cl.
*H01R 13/6596* (2011.01)
*H01R 13/6598* (2011.01)
(Continued)

(52) U.S. Cl.
CPC ..... *H01R 13/6598* (2013.01); *H01R 4/26* (2013.01); *H01R 4/62* (2013.01); *H01R 13/6585* (2013.01);
(Continued)

(58) Field of Classification Search
CPC ..... H01R 13/426; H01R 13/6582; H01R 13/6596
See application file for complete search history.

(56) References Cited

U.S. PATENT DOCUMENTS 3,335,396 A * 8/1967 Nava ..... H01R 13/426 439/744
3,648,222 A * 3/1972 Cowmeadow ..... H01R 13/6582 439/607.05
(Continued)

FOREIGN PATENT DOCUMENTS

CN 1200843 A 12/1998
CN 104247167 A 12/2014
(Continued)

OTHER PUBLICATIONS

PCT International Search Report and Written Opinion of the International Searching Authority, dated Jan. 9, 2017, 9 pages.
(Continued)

*Primary Examiner* — Tho D Ta
(74) *Attorney, Agent, or Firm* — Barley Snyder

(57) ABSTRACT

A shielding element for a connector comprises a sheet-shaped section, a passageway formed in the sheet-shaped section, and a contacting tab disposed at the passageway. The contacting tab protrudes from the sheet-shaped section and has a sharp cutting edge at a free end of the contacting tab.

20 Claims, 5 Drawing Sheets

(51) Int. Cl.

| | |
|---|---|
| ***H01R 4/26*** | (2006.01) |
| ***H01R 4/62*** | (2006.01) |
| ***H01R 13/6585*** | (2011.01) |
| *H01R 13/6582* | (2011.01) |
| *H01R 13/426* | (2006.01) |

(52) U.S. Cl.
CPC ..... *H01R 13/6596* (2013.01); *H01R 13/426* (2013.01); *H01R 13/6582* (2013.01)

(56) References Cited

U.S. PATENT DOCUMENTS

| | | | | |
|---|---|---|---|---|
| 4,061,413 | A | 12/1977 | Keller | |
| 4,241,976 | A * | 12/1980 | Oliver | H01R 13/426 29/458 |
| 4,362,350 | A * | 12/1982 | von Harz | H01R 13/426 439/607.12 |
| 4,371,226 | A * | 2/1983 | Brancaleone | H01G 4/228 29/854 |
| 4,512,618 | A * | 4/1985 | Kumar | H01R 13/658 439/95 |
| 5,823,826 | A * | 10/1998 | Ward | H01R 13/719 439/620.07 |
| 6,471,546 | B1 * | 10/2002 | Zhu | H01R 12/707 439/607.4 |
| 7,736,199 | B2 * | 6/2010 | Cossette | H01R 13/426 439/745 |
| 9,425,541 | B2 | 8/2016 | Data et al. | |
| 2015/0041211 | A1 | 2/2015 | Debock et al. | |
| 2015/0118902 | A1 | 4/2015 | Data et al. | |

FOREIGN PATENT DOCUMENTS

| | | | |
|---|---|---|---|
| JP | S51-64803 | A | 6/1976 |
| JP | 2015-521340 | A | 7/2015 |
| WO | 2013152261 | A1 | 10/2013 |
| WO | 2015072334 | A1 | 5/2015 |

OTHER PUBLICATIONS

Chinese First Office Action with English translation, Chinese Patent Application No. 201680061769.1, dated Mar. 4, 2019, 14 pages.
Japanese Notice of Reasons for Refusal with English translation, Japanese Patent Application No. 2018-538949, dated Apr. 17, 2019, 12 pages.
Japanese Notice of Reasons for Refusal with English translation, Japanese Patent Application No. 2018-538949, dated Jul. 30, 2019, 9 pages.
Chinese Second Office Action with English translation, Chinese Patent Application No. 201680061769.1, dated Oct. 9, 2019, 15 pages.
Japanese Notice of Reasons for Refusal, with English translation, Japanese Patent Application No. 2018-538949, dated Nov. 12, 2019, 8 pages.
European Patent Office Communication, dated Sep. 27, 2019, 7 pages.

* cited by examiner

SHIELDING ELEMENT FOR A CONNECTOR AND HOUSING ASSEMBLY HAVING PROTRUDING CUTTING PORTIONS

CROSS-REFERENCE TO RELATED APPLICATIONS

This application is a continuation of PCT International Application No. PCT/EP2016/075377 filed on Oct. 21, 2016, which claims priority under 35 U.S.C. § 119 to German Patent Application No. 102015220661.0, filed on Oct. 22, 2015.

FIELD OF THE INVENTION

The present invention relates to a connector and, more particularly, to a shielding element of a connector.

BACKGROUND

In known connectors, a contact or a shielding element of the connector often contacts a counter-element. When the counter-element is made from aluminum, oxide layers are formed on the surface of the aluminum. The oxide layers can impair the electrical connection between the shielding element and the counter-element.

In existing solutions, a sufficient contact resistance between the shielding element and the counter-element is generated primarily by large contact forces required to connect the shielding element and the counter-element. Such a configuration requires the shielding element and the counter-element to be robust and very stable during mating.

SUMMARY

A shielding element for a connector comprises a sheet-shaped section, a passageway formed in the sheet-shaped section, and a contacting tab disposed at the passageway. The contacting tab protrudes from the sheet-shaped section and has a sharp cutting edge at a free end of the contacting tab.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
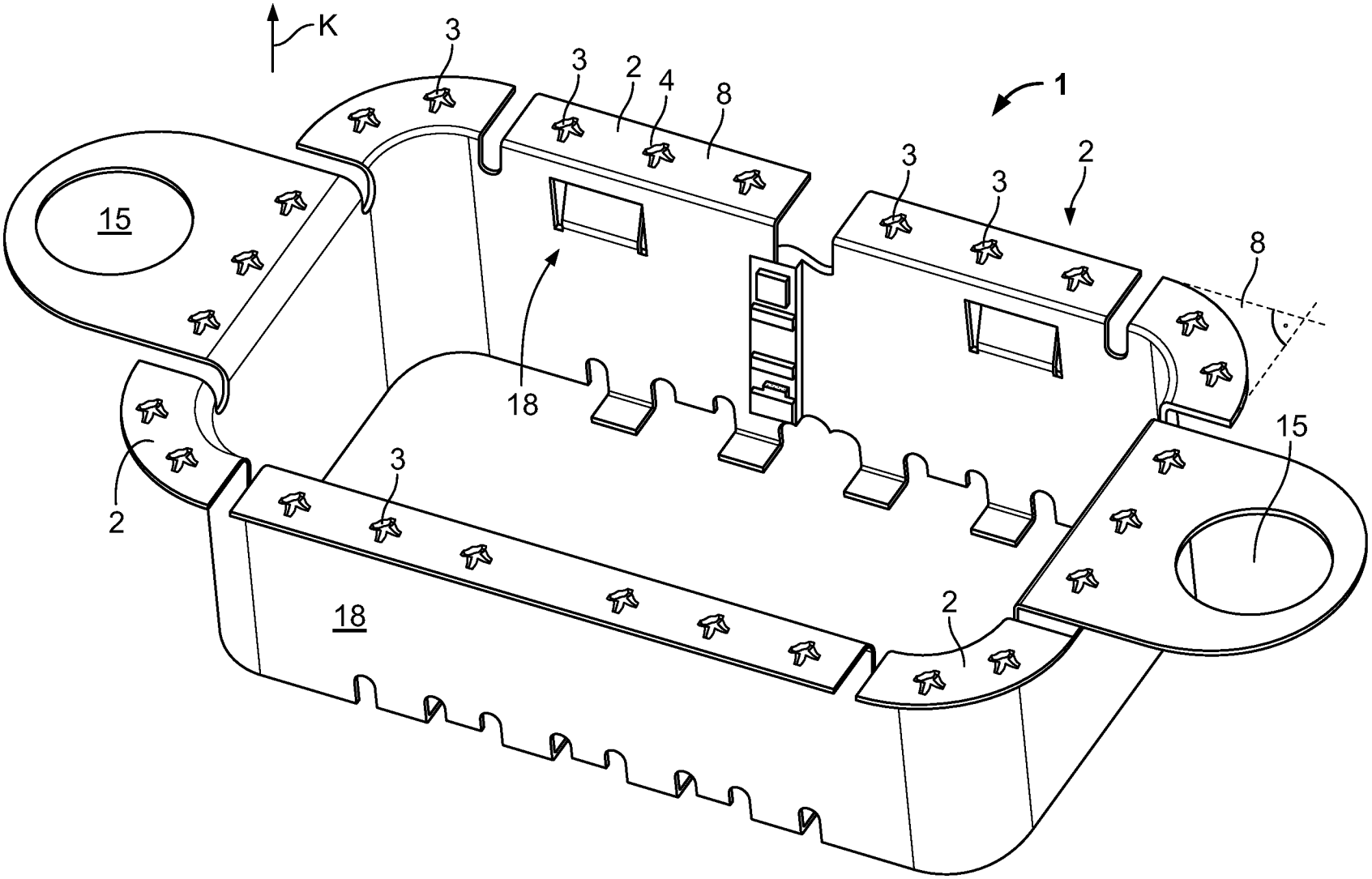
FIG. 1 is a perspective view of a shielding element according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

A shielding element 1 according to an embodiment is shown in FIG. 1. The shielding element 1 is configured to contact a counter-element 13 made from aluminum.

The shielding element 1 has several sheet-shaped sections 2, with several passageways 3 being formed in each of the sheet-shaped sections 2. The sheet-shaped sections 2 protrude from a main section 18 which is closed in a ring shape and which provides shielding. The passageways 3 are situated in a plane 8 such that the shielding element 1 can contact a planar surface of the counter-element 13. At each passageway 3 there is at least one contacting tab 4 disposed around the passageway 3 which protrudes from the shielding element 1. In an embodiment, the shielding element 1 acts as electromagnetic shielding. The sheet-shaped section 2 is situated outside the main section 18 so as not to impair the shielding effect.

In an embodiment, the shielding element 1 can be manufactured in a single piece by embossing and stamping a metal sheet. In other embodiments, the shielding element 1 can be manufactured by bending, cutting, and/or welding.

Figure 2:
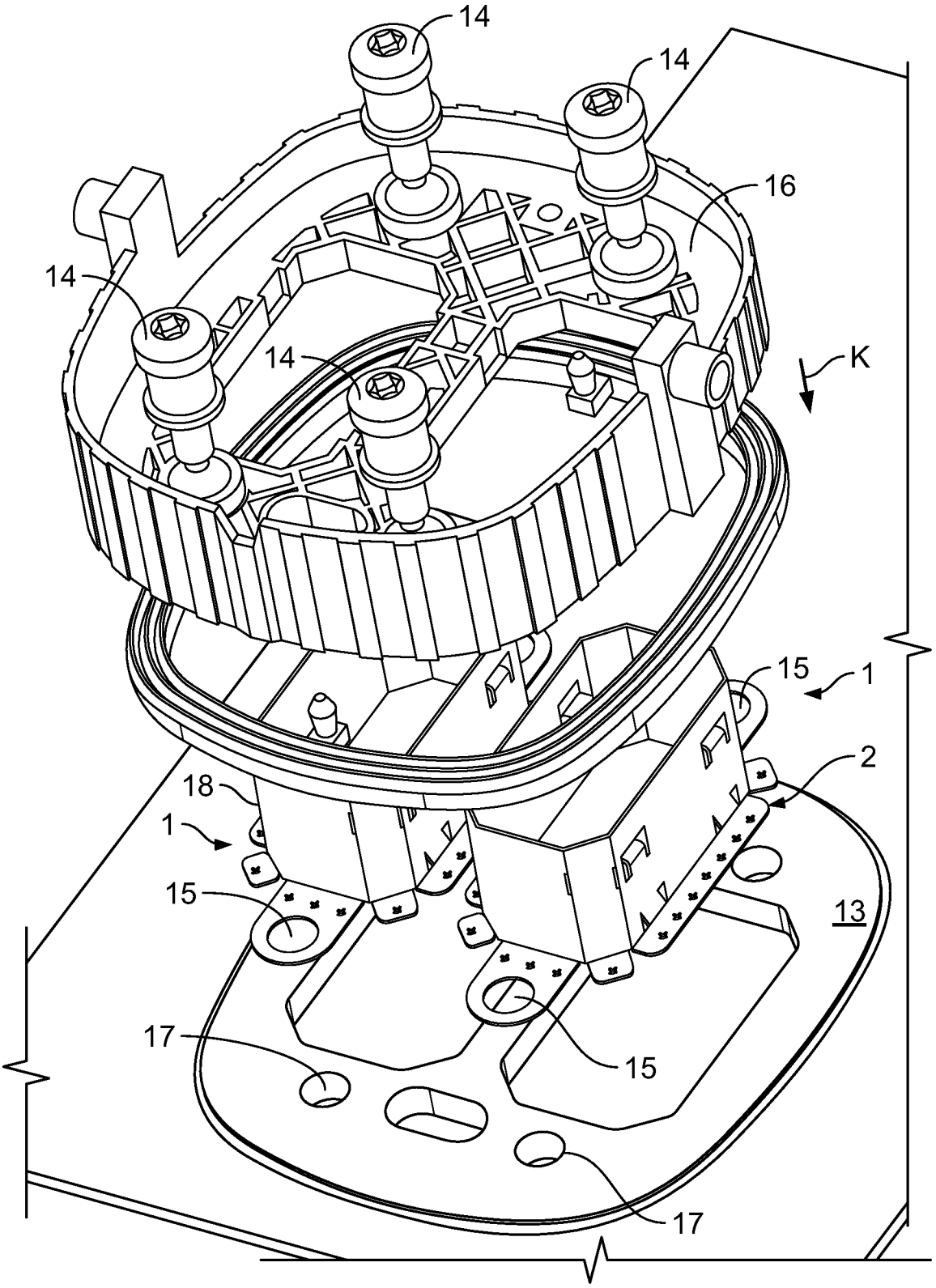
FIG. 2 is an exploded perspective view of a plurality of shielding elements with a counter-element.
Figure 3:
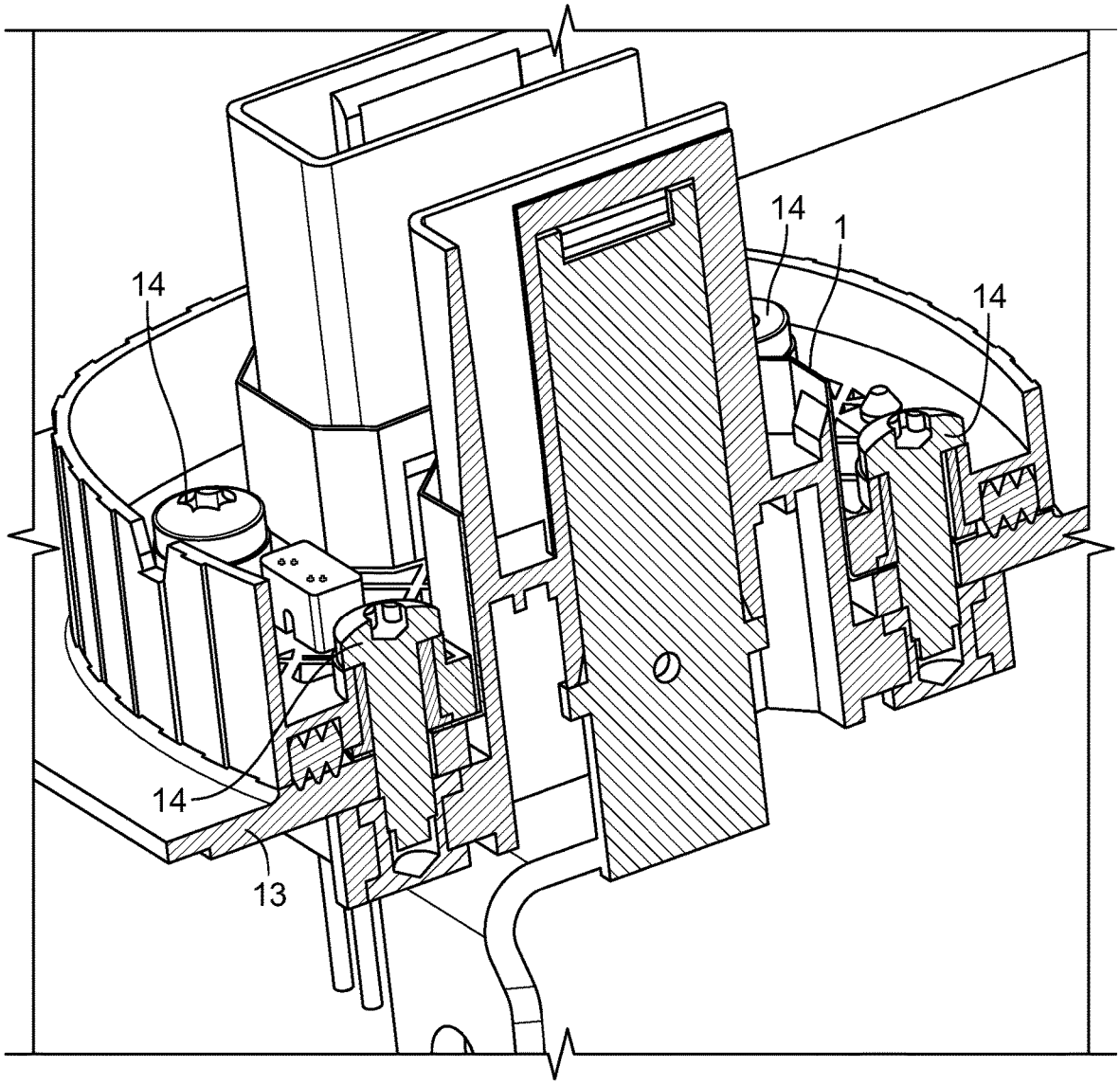
FIG. 3 is a sectional view of the shielding elements and counter-element of FIG. 2 in an assembled state.

The shielding element 1 is shown with the counter-element 13 and a retaining element 16 in FIGS. 2 and 3. Mounting elements 14 in the form of screws are guided through the retaining element 16, mounting openings 15 of the shielding element 1, and mounting openings 17 on the counter-element 13. The mounting elements 14 move the shielding element 1 along a contact direction K onto the counter-element 13 into an assembled state shown in FIG. 3. In another embodiment, the mounting element 14 may be rivets.

The contacting tab 4, as shown in the various embodiments of FIGS. 4A-4D, has a protruding sharp cutting edge 6 at a free end 5. It is possible to easily penetrate aluminum oxide layers present on the counter-element 13 due to the sharp cutting edges 6 such that, even with little exertion of force, secure contacting of an underlying aluminum layer is possible with a low transition resistance. No large forces are required in this case and the shielding element 1 and counter-element 13 therefore do not have to be configured in such a stable manner, saving on manufacturing costs. The contacting tabs 4 with the sharp cutting edges 6 are arranged along an entire periphery such that uniform contacting takes place.

Figure 4B:
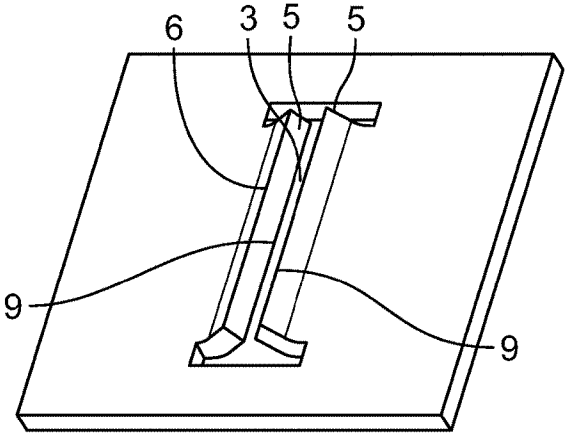
FIG. 4B is a schematic perspective view of a contacting tab of the shielding element according to another embodiment.
Figure 4D:
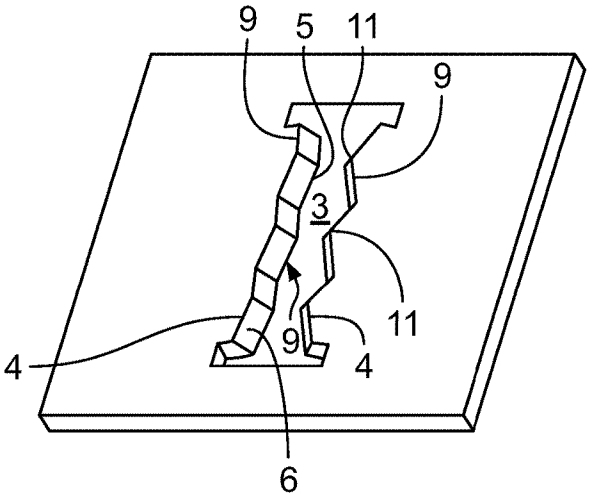
FIG. 4D is a schematic perspective view of a contacting tab of the shielding element according to another embodiment.
Figure 4A:
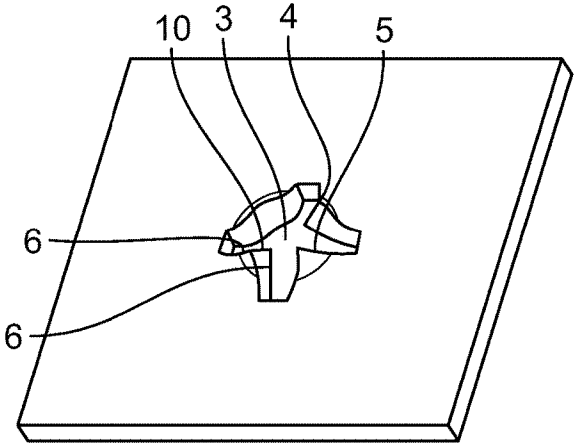
FIG. 4A is a schematic perspective view of a contacting tab of the shielding element according to an embodiment.

In the embodiment of FIG. 4A, four contacting tabs 4 protrude into the passageway 3. Each contacting tab 4 has two sharp cutting edges 6 which are adjacent and taper towards one another to form a cutting corner 10. The cutting corner 10 has an angle of approximately 90°. The four contact tabs 4 delimit the passageway 3 which is approximately cross-shaped or star-shaped in this embodiment.

The embodiment of FIG. 4B has an elongated passageway 3, at the longitudinal sides 9 of which two contacting tabs 4 are disposed opposite one another. The contacting tabs 4 each have, at their free ends 5, a protruding sharp cutting edge 6.

Figure 4C:
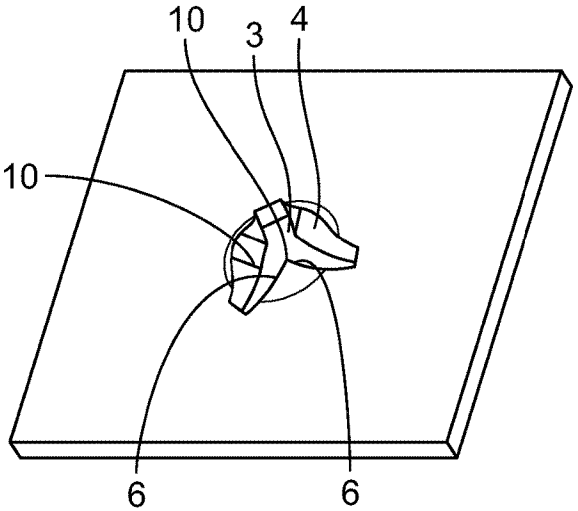
FIG. 4C is a schematic perspective view of a contacting tab of the shielding element according to another embodiment.

There are three contacting tabs 4 in the embodiment of FIG. 4C. The remaining passageway 3 is star-shaped and adjacent cutting edges 6 of each contacting tab 4 form a cutting corner 10.

The embodiment of FIG. 4D has a plurality of cutting jags 11 at the cutting edges 6. Similar to the cutting corners 10, the cutting jags 11 can penetrate through the oxide layer more easily and can remove the oxide layer with a saw-type movement. The cutting jags 11 are positioned on the contacting tabs 4 at the longitudinal sides 9 of the elongated passageway 3

Figure 5:
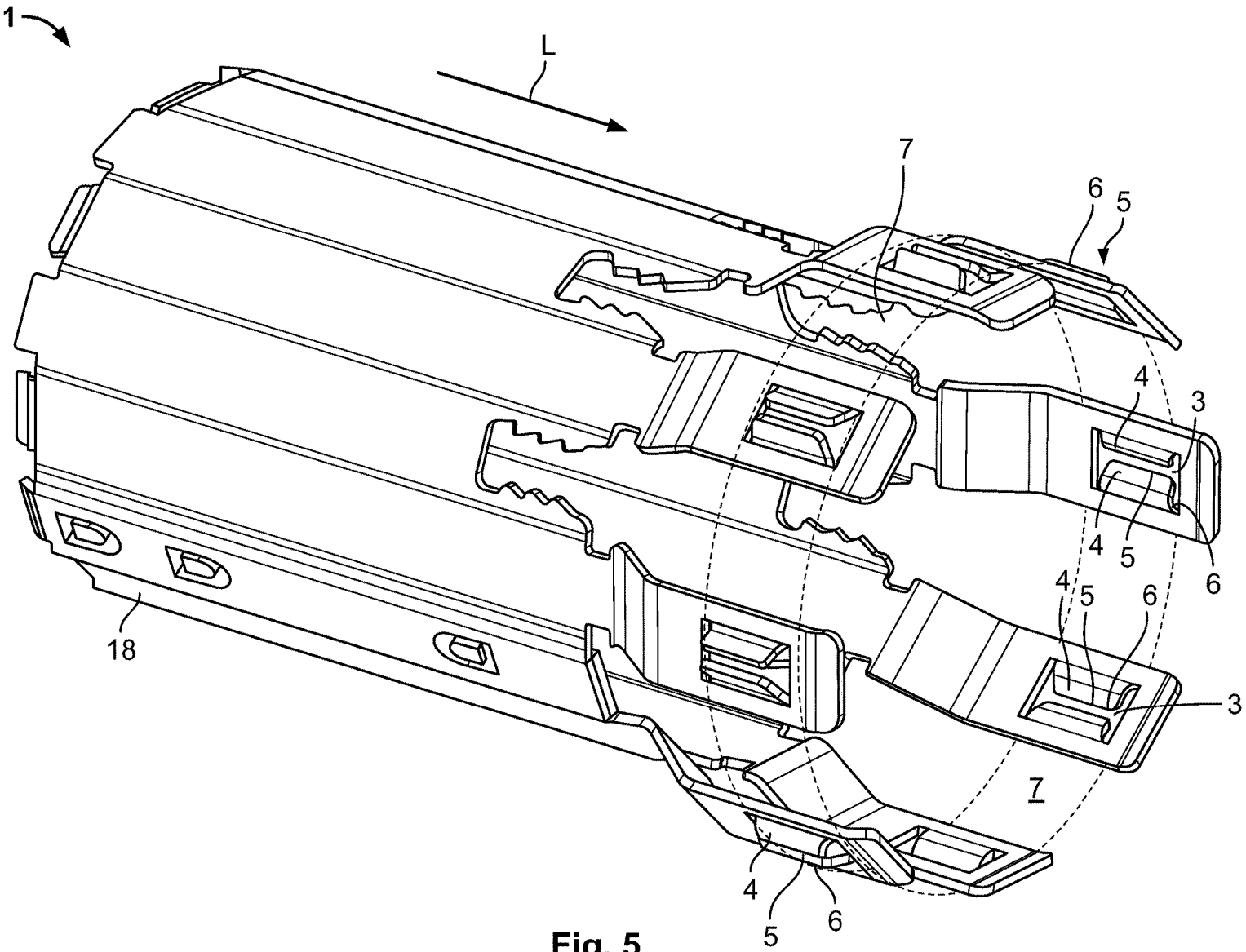
FIG. 5 is a perspective view of a shielding element according to another embodiment.

A shielding element 1 according to another embodiment is shown in FIG. 5. Like reference numbers refer to like elements with respect to the embodiment shown in FIGS. 1-4D.

As shown in FIG. 5, the passageways 3 are situated in sheet-shaped sections 2 and are arranged on a cylinder shell surface 7 in order to contact a corresponding cylinder shell-shaped counter surface. The sheet-shaped sections 2 protrude from an annular main section 18 which acts as electromagnetic shielding. Contacting tabs 4 are situated at the passageways 3. The contact tabs 4 have protruding sharp cutting edges 6 at the free ends 5. The sharp cutting edges 6 in this case protrude radially outwards. In another embodiment, they protrude radially inwards, for instance if it is desired to contact a correspondingly configured counter-element.

Two contacting tabs 4 respectively at each passageway 3 extend in opposite directions relative to a periphery as shown in FIG. 5 such that, when the shielding element 1 moves in the peripheral direction, one contacting tab 4 extends runs in the direction of movement and the other contacting tab 4 extends against the direction of movement. As a result, at least one contacting tab 4 in each case can break through an oxide layer. Due to the cutting edges 6 extending in a longitudinal direction L, a movement in the longitudinal direction L also leads to a penetration of the oxide layers.

What is claimed is:

1. A shielding element for a connector, comprising:

a main section forming an enclosed ring shape;

a sheet-shaped section having a mounting opening at an end, the mounting opening projecting in a contact direction, the sheet-shaped section protrudes from the main section in a direction orthogonal to the main section;

a passageway formed in the sheet-shaped section adjacent to the mounting opening; and a contacting tab disposed at the passageway, the contacting tab protruding from the sheet-shaped section in the contact direction orthogonal to the sheet-shaped section and having a sharp cutting edge at a free end of the contacting tab.

2. The shielding element of claim 1, wherein a plurality of contacting tabs are disposed around the passageway.

3. The shielding element of claim 1, wherein the passageway has an elongated shape and a pair of contacting tabs are disposed on opposite longitudinal sides of the passageway.

4. The shielding element of claim 1, wherein a pair of adjacent cutting edges of the contacting tab form a cutting corner.

5. The shielding element of claim 1, wherein the cutting edge has a plurality of cutting jags.

6. The shielding element of claim 1, wherein the shielding element is monolithically formed in a single piece from metal sheet.

7. The shielding element of claim 1, wherein the sheet-shaped section is configured to contact a counter-element.

8. The shielding element of claim 1, wherein a plurality of passageways are disposed on a cylinder shell surface.

9. The shielding element of claim 8, wherein the sharp cutting edge protrudes radially outward from the cylinder shell surface.

10. The shielding element of claim 1, wherein a plurality of passageways are disposed in a plane.

11. The shielding element of claim 10, wherein the sharp cutting edge protrudes from the plane.

12. The shielding element of claim 1, further comprising a plurality of sheet-shaped sections extending orthogonal to the main section.

13. The shielding element of claim 12, wherein each of the plurality of sheet-shaped section has a plurality of passageways.

14. The shielding element of claim 13, wherein the passageways are arranged around an entire periphery of the ring shape.

15. The shielding element of claim 14, wherein the passageways are disposed in a plane.

16. The shielding element of claim 15, wherein the sharp cutting edge of the contact tab of each of the passageways protrudes from the plane.

17. A housing assembly, comprising:

a shielding element including a main section forming an enclosed ring shape, a sheet-shaped section having a mounting opening at an end, the mounting opening projecting in a contact direction, the sheet-shaped section protrudes from the main section in a direction orthogonal to the main section, a passageway formed in the sheet-shaped section adjacent to the mounting opening, and a contacting tab disposed at the passageway, the contacting tab protruding from the sheet-shaped section in the contact direction orthogonal to the sheet-shaped section and having a sharp cutting edge at a free end of the contacting tab; and a counter-element contacting the sheet-shaped section of the shielding element.

18. The housing assembly of claim 17, further comprising a mounting element configured to move the shielding element into contact with the counter-element.

19. The housing assembly of claim 17, wherein the counter-element is made of aluminum.

20. The housing assembly of claim 19, wherein the sharp cutting edge penetrates an aluminum oxide layer and contacts and underlying aluminum layer of the counter-element.

* * * * *